US010013898B2

(12) United States Patent
Jacobs et al.

(10) Patent No.: US 10,013,898 B2
(45) Date of Patent: Jul. 3, 2018

(54) MULTI-POSITION BIASED ROTATING LOGO COMPONENT

(71) Applicant: Microsoft Technology Licensing, LLC, Redmond, WA (US)

(72) Inventors: Joel Jacobs, Redmond, WA (US); Jesse Staub, San Francisco, CA (US); Perry Q. Anderson, Redmond, WA (US); Craig K. Black, Bellevue, WA (US); Jonathan B. Hadley, Renton, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 167 days.

(21) Appl. No.: 14/814,324

(22) Filed: Jul. 30, 2015

(65) Prior Publication Data

US 2017/0032712 A1 Feb. 2, 2017

(51) Int. Cl.

| | |
|---|---|
| ***G09F 3/00*** | (2006.01) |
| ***G09F 3/20*** | (2006.01) |
| ***G09F 7/22*** | (2006.01) |

(52) U.S. Cl.

CPC . *G09F 3/20* (2013.01); *G09F 7/22* (2013.01)

(58) Field of Classification Search

CPC ..... G06F 1/181; G06F 1/1683; G06F 1/187; G06F 1/1616; G06F 1/1656; G06F 1/1681; G06F 1/1679

USPC .... 40/642.02, 427, 446, 493, 482, 484, 506; 446/330, 331; 116/285, 284, 303; 361/679.21, 679.24, 679.27

See application file for complete search history.

(56) References Cited

U.S. PATENT DOCUMENTS

| | | | | |
|---|---|---|---|---|
| 5,139,454 | A * | 8/1992 | Earnest | B42D 15/045 40/124.12 |
| 6,477,799 | B1 * | 11/2002 | Erickson | G09F 19/02 40/406 |
| 6,848,965 | B2 * | 2/2005 | Wong | A63H 3/18 40/436 |
| 7,365,968 | B2 * | 4/2008 | Chen | G09F 7/00 248/122.1 |
| 7,654,718 | B2 | 2/2010 | Tye et al. | |
| 7,954,247 | B1 | 6/2011 | Plucknett | |

(Continued)

FOREIGN PATENT DOCUMENTS

CN 203178889 U 9/2013

OTHER PUBLICATIONS

Nelson, J.R., "Dell Studio Hybrid Desktop Review", Published on: Aug. 24, 2008, Available at: http://www.notebookreview.com/desktopreview/dell-studio-hybrid-desktop-review/, 9 pages.

*Primary Examiner* — Cassandra H Davis
(74) *Attorney, Agent, or Firm* — Holzer Patel Drennan

(57) ABSTRACT

The presently disclosed multi-position biased rotating logo components permit an electronic device to display a logo associated with the device in a variety of positions with reference to a device housing while the device is re-positioned in different orientations. This allows the logo to maintain a desired orientation with reference to a support surface or a direction of gravity as the device is re-positioned in the different orientation. Further, the rotating logo is biased to achieve and maintain two or more preselected orientations within the housing that correspond to two or more intended orientations of the device.

18 Claims, 13 Drawing Sheets

(56) References Cited

U.S. PATENT DOCUMENTS

| | | | | |
|---|---|---|---|---|
| 8,003,886 | B1 | 8/2011 | Rintz | |
| 8,051,592 | B2 | 11/2011 | Chang | |
| 8,434,890 | B2 | 5/2013 | Baillie | |
| 8,646,195 | B2 | 2/2014 | Fu et al. | |
| 8,994,662 | B2 | 3/2015 | Nakamura | |
| 2002/0190968 | A1 | 12/2002 | Barnes et al. | |
| 2005/0157455 | A1 | 7/2005 | Hernandez et al. | |
| 2005/0159455 | A1* | 7/2005 | Pullela | C07D 211/90 514/338 |
| 2006/0012949 | A1* | 1/2006 | Hutchinson | H05K 5/0252 361/679.21 |
| 2009/0052180 | A1 | 2/2009 | Baillie | |
| 2014/0133763 | A1 | 5/2014 | van Zwol et al. | |

* cited by examiner

MULTI-POSITION BIASED ROTATING LOGO COMPONENT

BRIEF DESCRIPTIONS OF THE DRAWINGS

DETAILED DESCRIPTIONS

Figure 1:
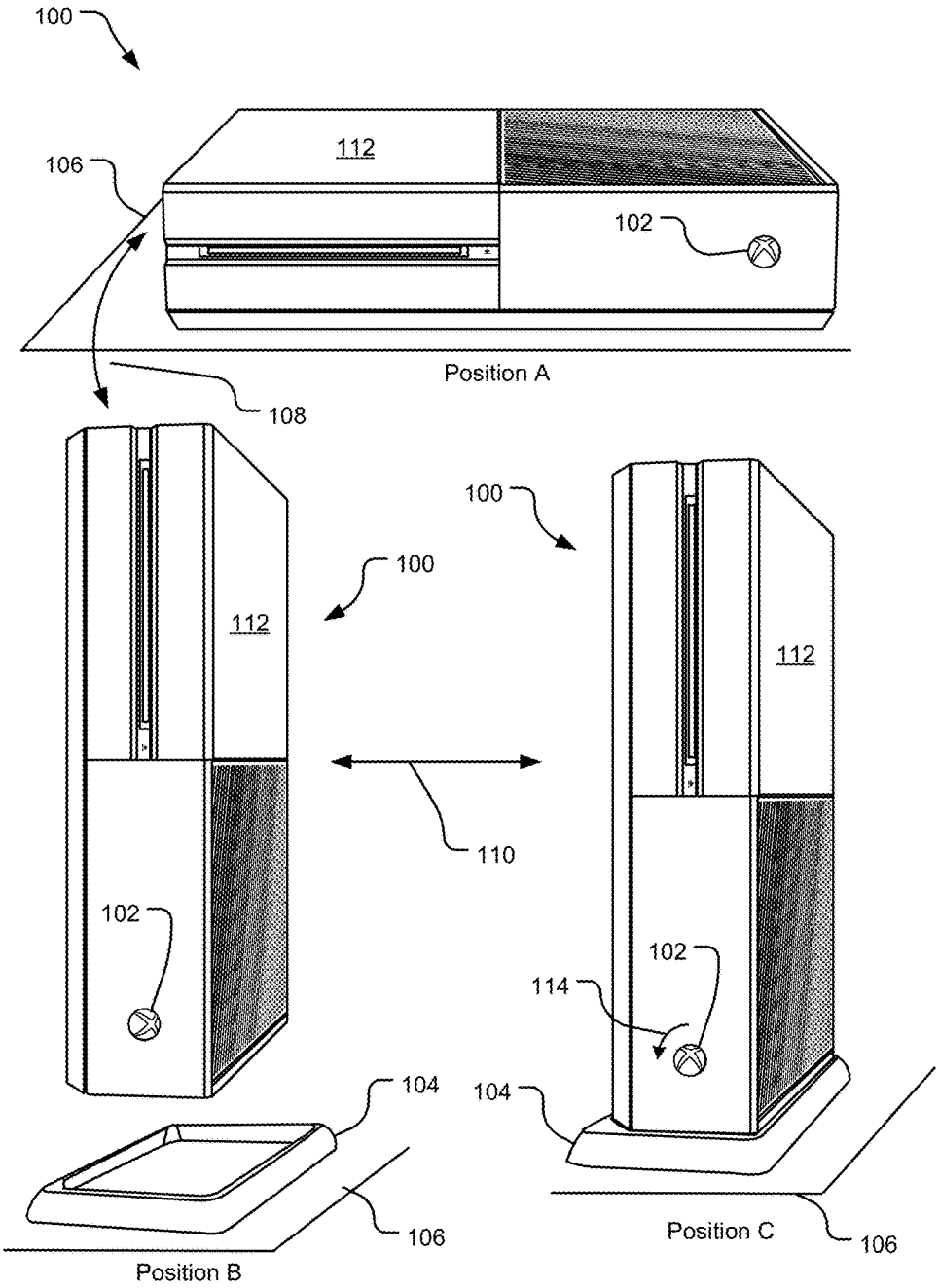
FIG. 1 illustrates an electronic device with an example multi-position biased rotating logo component actuated by seating the device on a device stand.

Logos are graphic marks, emblems, symbols, etc. commonly used by commercial, governmental, or non-profit entities, or individuals to aid and promote public recognition. Logos can be graphic in nature (e.g., a symbol or icon), composed of a textual name of the associated organization (e.g., a logotype or wordmark), or some combination thereof. Often logos are intended to be viewed at a certain orientation in order to maximize public recognition of the logo and association with the organization.

Electronic devices with multi-position biased orientation-changing logo components are disclosed herein. Each device can include a housing configured to be positioned in two or more housing orientations with respect to a reference (such as a support surface, one or more attachment locations, a wrist, or an axis), and a logo component rotationally connected to the housing and biased to each of two or more logo orientations with respect to the housing. The logo component is configured to maintain a logo orientation with respect to the reference in all of the housing orientations. Non-electronic devices can also benefit from the disclosed technology.

Further, methods of re-orienting a logo on an electronic device are disclosed herein. These methods include positioning the electronic device at a selected one of two or more housing orientations with respect to a reference (such as a support surface) and rotating a logo component with respect to the housing to maintain a logo orientation with respect to the reference at the selected housing orientation, wherein the logo component is biased to each of two or more logo orientations with respect to the housing.

Other disclosed electronic devices can include a housing configured to be positioned at two or more housing orientations with respect to a reference (such as a support surface); a logo component rotationally connected to the housing and biased to each of two or more logo orientations with respect to the housing, wherein the logo component is configured to maintain a logo orientation with respect to the reference in all of the housing orientations; a device stand including an orientation actuator; and a rotation mechanism fixedly attached to the logo component, wherein the orientation actuator triggers the rotation mechanism to rotate the logo component to a different one of the logo orientations with respect to the housing when the housing is seated on the device stand.

Other implementations are also described and recited herein.

When a product typically maintains a fixed orientation with reference to a support surface, a logo can be fixedly attached to the product with little to no risk that the logo is viewed by a user or the public at a non-intended orientation. However, some products are intended to be positioned at two or more orientations with reference to the support surface. As a result, there is a substantial risk that a fixed logo on such products is viewed by the user or the public at a non-intended orientation, which can diminish public recognition of the logo and association with the organization.

FIGS. 1-12 illustrate various example implementations of multi-position biased rotating logo components, particularly used in conjunction with electronic devices. The logo components are used to aid public recognition of depicted logos and association of the electronic devices with organizations associated with the depicted logos.

FIG. 1 illustrates an electronic device 100 with an example multi-position biased rotating logo component 102 actuated by seating the device 100 on a device stand 104. The device 100 is depicted in three positions, "Position A," "Position B," and "Position C." Position A depicts the device 100 at rest in a horizontal orientation on a support surface 106. The logo component 102 is oriented at a desired orientation with respect to the support surface 106. As illustrated by arrow 108, the device 100 can be moved to Position B, which places the device 100 in a vertical orientation with respect to the support surface 106, but not seated within the device stand 104. However, the logo component 102 remains in the orientation depicted in Position A, which is not ideal for Position B.

As illustrated by arrow 110, the device 100 can be moved to Position C, which seats the device 100 within the device stand 104. The device stand 104 secures the device 100 in the vertical orientation and actuates the logo component 102 to rotate approximately 90 degrees with reference to device housing 112, as illustrated by arrow 114, to again achieve the desired orientation with respect to the support surface 106 (see also Position A). The device 100 includes a rotation mechanism (not shown, see e.g., FIGS. 3-12) that permits the logo component 102 to rotate with reference to the device housing 112. One or both of the rotation mechanism and the device stand 106 includes an orientation actuator (also not shown, see e.g., FIGS. 3-4) that triggers the logo component 102 to rotate with reference to the device housing 112 when the device 100 is placed in close proximity or contact with the device stand 106. Arrows 108, 110 illustrate that the device 100 can be moved back-and-forth between Positions A-C, while repeatedly and automatically achieving the desired logo component orientation in Positions A and C.

While the device 100 is depicted as an Xbox® One™ by Microsoft Corporation, in other implementations the device 100 can be any gaming console, desktop computer, monitor, speaker, household appliance, and/or consumer product, for example. Other examples include wearable components, such as wrist watches, wristbands, bracelets, glasses, necklaces, visors, etc. The device 100 can have a variety of sizes and shapes, so long as it is intended to be placed in two or more orientations with reference to the support surface 106 (e.g., the depicted horizontal and vertical orientations). Similarly, while the logo component 102 is circular and displays an Xbox® logo, in other implementations the logo component 102 can have a variety of sizes and shapes and can display any logo associated with any entity or individual, particularly any logo that is intended to be viewed at one or more desired logo orientations. If the device 100 is intended to be placed in three or more orientations with reference to the support surface 106, then the logo component 102 can also be rotatable to three or more orientations with reference to the device housing 112. Further, the logo component 102 can be backlit in a variety of colors and can double as a power or control switch (e.g., a button, a toggle switch, a rocker switch, a dial, etc.). The logo component 102 can further double as an indicator that the device stand 104 is securely attached to the device 100.

While the device stand 104 is depicted as a generally rectangular structure with a recess that matches surfaces of the device 100 intended to seat within the device stand 104, in other implementations, the device stand 104 can have a variety of sizes and shapes that allow it to interface with electronic devices with a variety of sizes and shapes. The support surface 106 is generally planar and can be a floor, shelf, table, countertop, or desk, for example. The support surface 106 is generally parallel with a ground surface, however it can be angled with respect to the ground surface by any number of degrees (e.g., if the support surface 106 is not level). The support surface 106 can also vary in angle with respect to the ground surface (e.g., the support surface is on a moving vehicle (e.g., a car, boat, or airplane). As a result, in one implementation, two logo orientations that are about 90 degrees apart can vary from 85 to 95 degrees apart, for example, although other orientations are also contemplated. The described technology can be applied to a device (electronic or non-electronic) that is changing its orientation, with some implementations being associated with a support surface and other implementations being independent of a support surface.

In order to promote and/or smooth transitions between orientations of the logo component 102 with respect to the device housing 112, the rotation mechanism can include a biasing and/or dampening mechanism(s) (not shown). Example biasing mechanisms may include an over-center or bi-stable mechanism. The biasing mechanism biases the logo component 102 orientation with respect to the device housing 112 to two or more desired logo component orientations. For example, the logo component 102 is biased to achieve and hold the logo orientations depicted in Positions A-C of the device 100. When moving between Positions B and C, the logo component 102 holds its orientation up to a point of close proximity or contact with the device stand 106 that overcomes the bias that holds the logo component 102 in a current logo component orientation. At that point, an overriding bias moves the logo component 102 quickly and securely to a new logo component orientation. Example biasing mechanisms are depicted in FIGS. 3 and 6-9 and described in detail below.

The dampening mechanism dampens movement of the logo component 102 between logo component 102 orientations with respect to the device housing 112. For example, any and all pivot points within the rotation mechanism could be dampened, any springs within the rotation mechanism could incorporate a dampening strut or other structure, and/or the rotation mechanism could be suspended in a fluid to dampen the rotation of the logo component 102. The dampening mechanism makes transitions between the logo orientations depicted in Positions A-C of the device 100 appear smooth and fluid to a user.

The above descriptions of the device 100 also apply to the additional electronic devices and rotation mechanisms illustrated in FIGS. 2-12 and described in detail below.

Figure 2:
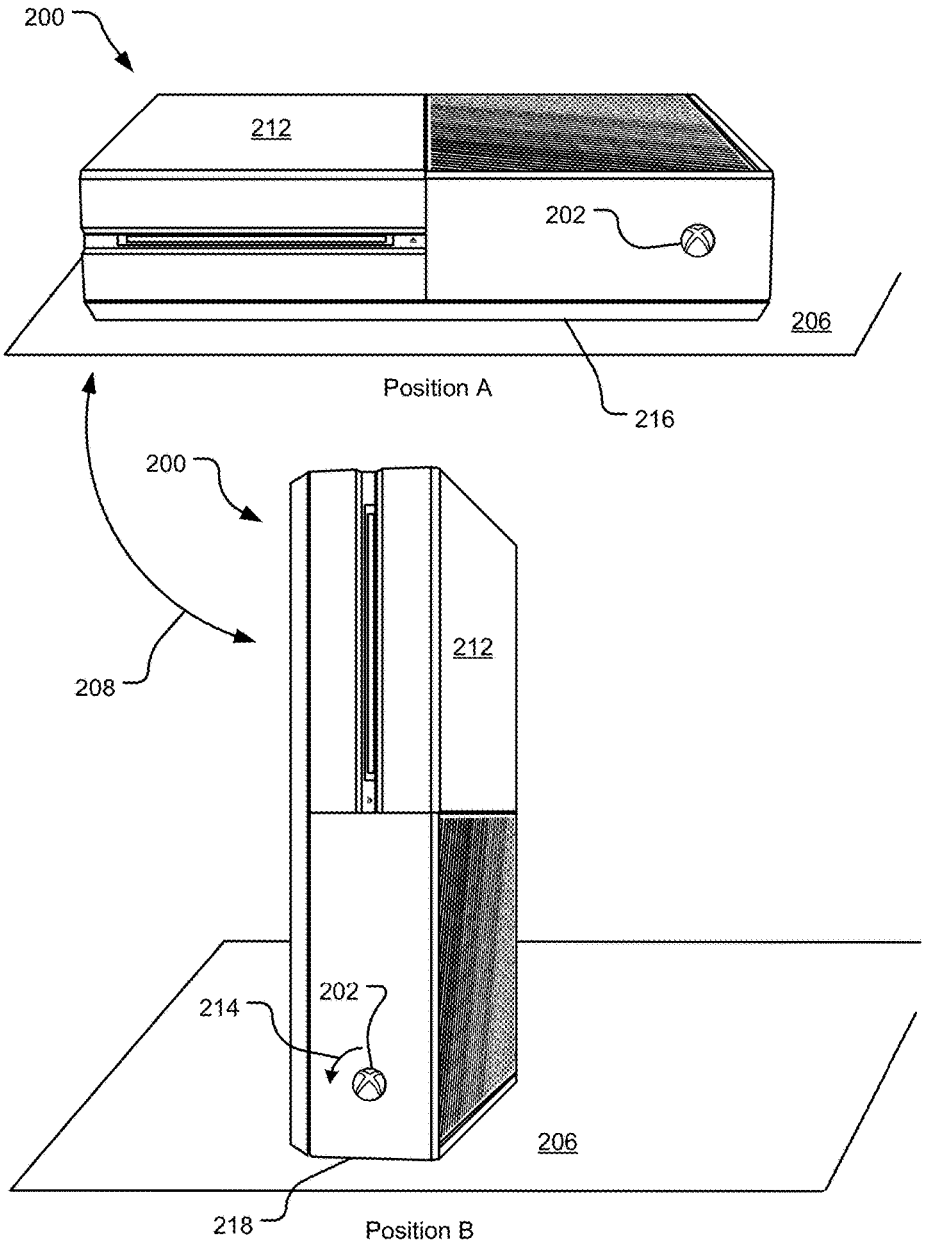
FIG. 2 illustrates an electronic device with an example multi-position biased rotating logo component actuated by rotating the device into a vertical orientation.

FIG. 2 illustrates an electronic device 200 with an example multi-position biased rotating logo component 202 actuated by rotating the device 200 into a vertical orientation, such as placing it on a support surface 206. The device 200 is depicted in two positions, "Position A" and "Position B." Position A depicts the device 200 at rest in a horizontal orientation on the support surface 206. The logo component 202 is oriented at a desired orientation with respect to the support surface 206. As illustrated by arrow 208, the device 200 can be moved to Position B, which places the device 200 in a vertical orientation with respect to the support surface 206. The logo component 202 rotates approximately 90 degrees with reference to device housing 212, as illustrated by arrow 214, to again achieve the desired orientation with respect to the support surface 206 (see also Position A).

The device 200 includes a rotation mechanism (not shown, see e.g., FIGS. 3-12) that permits the logo component 202 to rotate with reference to the device housing 212. The rotation mechanism includes an orientation actuator (also not shown, see e.g., FIGS. 3-4) that triggers the logo component 202 to rotate with reference to the device housing 212. In some implementations, proximity and/or contact of the device 200 of one of device surfaces 216, 218 with the support surface 206 triggers the orientation actuator. More specifically, proximity and/or contact of the of device surface 216 with the support surface 206 can cause the logo component 202 to achieve and maintain the logo orientation depicted in Position A. Proximity and/or contact of the of device surface 218 with the support surface 206 can cause the logo component 202 to achieve and maintain the logo orientation depicted in Position B. In other implementations, gravitation force can trigger the logo component 202 to rotate with reference to the device housing 212 to achieve and maintain the desired logo orientation (see e.g., FIGS. 9-10).

In order to promote and/or smooth transitions between orientations of the logo component 202 with respect to the device housing 212, the rotation mechanism can include a biasing and/or dampening mechanism(s) (not shown, see e.g., FIGS. 3 and 6-9). Arrow 208 illustrates that the device 200 can be moved back-and-forth between Positions A and B, while repeatedly and automatically achieving the desired logo component orientation in Positions A and B.

Figure 3:
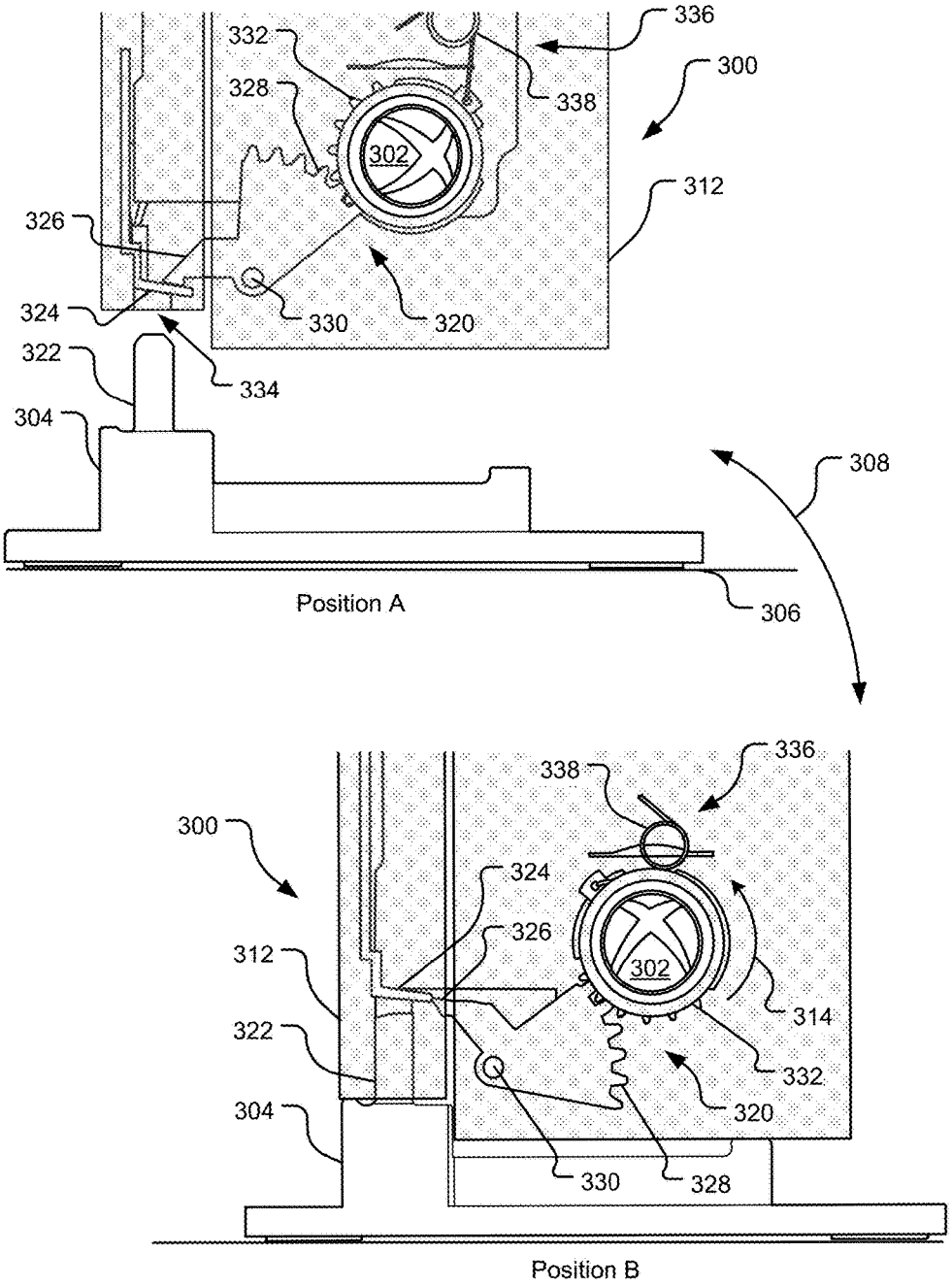
FIG. 3 illustrates an elevation view of a first example rotation mechanism for a multi-position biased rotating logo component in non-actuated and actuated positions.

FIG. 3 illustrates an elevation view of a first example rotation mechanism 320 for a multi-position biased rotating logo component 302 in non-actuated and actuated positions. In various implementations, the rotation mechanism 320 can be partially or fully hidden within an interior of electronic device 300. The device 300 is depicted in two positions, "Position A" (or "non-actuated") and "Position B" (or "actuated").

Position A depicts the device 300 in a vertical orientation with respect to support surface 306, but not seated within device stand 304. In Position B, the device stand 304 secures the device 300 in the vertical orientation and actuates the logo component 302 to rotate approximately 90 degrees with reference to device housing 312, as illustrated by arrow 314, to achieve a desired orientation with respect to the support surface 306. Arrow 308 illustrates that the device 300 can be moved back-and-forth between Positions A and B, while repeatedly and automatically achieving the desired logo component orientation in Position B.

The rotation mechanism 320 permits the logo component 302 to rotate with reference to the device housing 312. More specifically, the rotation mechanism 320 includes a pin (or orientation actuator) 322 that projects from the device stand 304. The pin 322 selectively moves a pad 324 linearly within the device 300. The pad 324 engages an arm 326, which is pivotally connected to a first sector gear 328 about pivot point 330. The first gear 328 engages a second sector gear 332, which is incorporated as part of the logo component 302.

As the device 300 is moved from Position A to Position B, the pin 322 enters an aperture 334 in the device 300, depressing the pad 324 linearly into the device 300. Linear movement of the pad 324 is transferred to clockwise rotational movement of the arm 326 about the pivot point 330. The first gear 328 also rotates clockwise about the pivot point 330 and engages teeth of the second gear 332, which rotates the logo component 302 counterclockwise, as illustrated by arrow 314. In various implementations, the rotation mechanism 320 incorporates hard stops that prevent the logo component 302 from rotating beyond a sector between Position A and Position B.

Dimensions of the pin 322, pad 324, arm 326, first gear 328, and the second gear 330 are selected such that the logo component 302 is moved from a previous desired logo orientation with respect to the housing 312 (e.g., the logo orientation depicted in Position A) to a new desired logo orientation with respect to the housing 312 (e.g., the logo orientation depicted in Position B), while fitting within allotted space within the housing 312. Movement from Position B to Position A is the opposite of that described above. The two logo orientations depicted in FIG. 3 are about 90 degrees apart. In other implementations, the two logo orientations can be about 180 degrees apart, about 120 degrees apart, or have any other desired angular separation.

In order to promote and/or smooth transitions between orientations of the logo component 302 with respect to the device housing 312, the rotation mechanism 320 can include a biasing and/or dampening mechanism 336. The mechanism 336 biases the logo component 302 orientation with respect to the device housing 312 to at least the two depicted desired logo component orientations. More specifically, the mechanism 336 includes an over-center spring 338 that pushes the logo component 302 toward each of the two depicted desired logo component orientations and away from any other logo orientations.

For example, the logo component 302 is biased to achieve and hold the logo orientations depicted in Positions A and B of the device 300. When moving from Position A to Position B, the logo component 302 resists rotation up to a point of engagement with the device stand 306 that overcomes the bias that holds the logo component 302 in the logo component orientation of Position A. At that point, an overriding bias moves the logo component 302 quickly and securely to the logo component orientation depicted in Position B. The mechanism 336 can also dampen movement of the logo component 302 between logo component 302 orientations with respect to the device housing 312, thus making transitions between the logo orientations depicted in Positions A and B of the device 300 appear smooth and fluid to a user.

Figure 4:
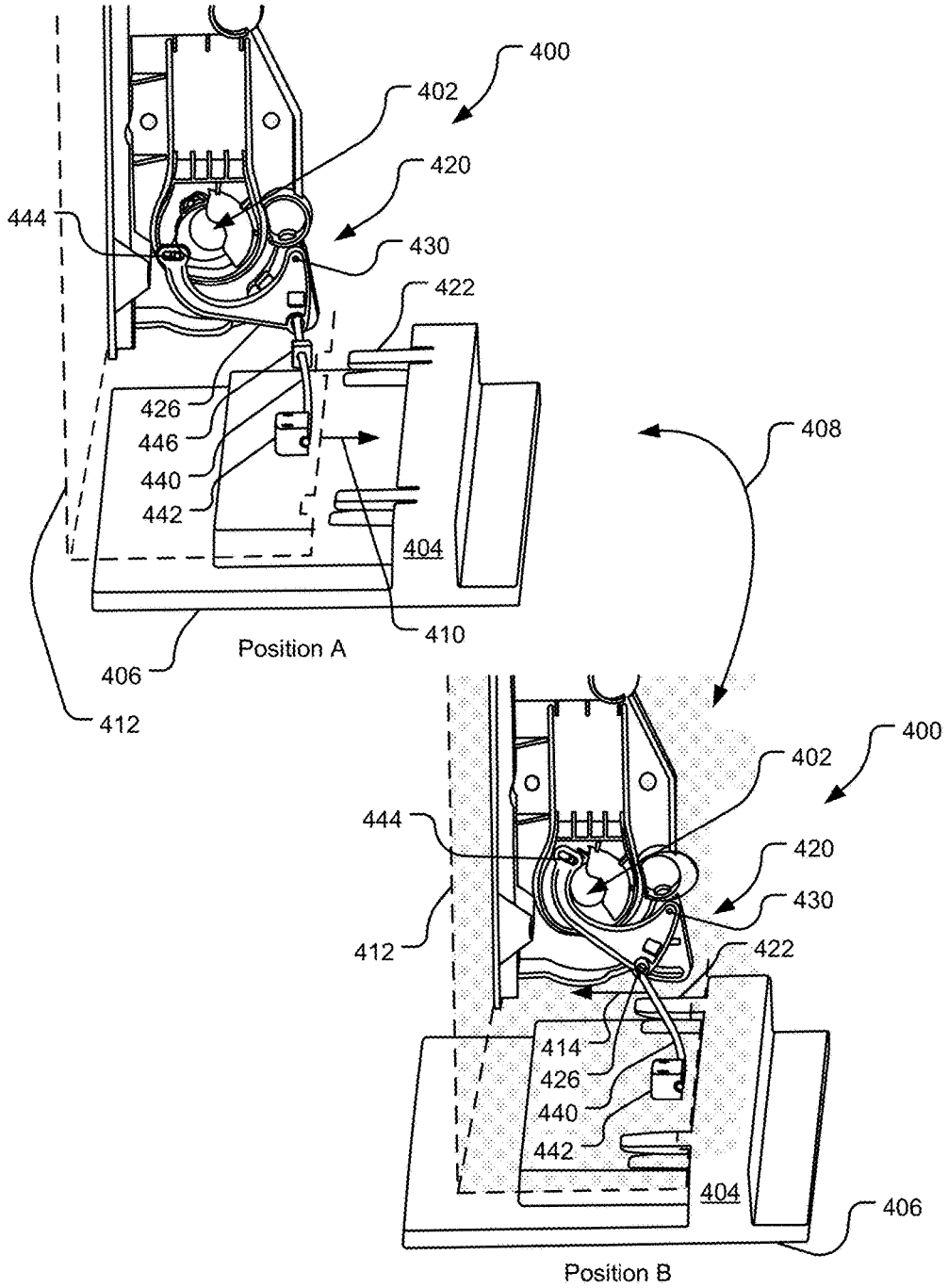
FIG. 4 illustrates a perspective view of a second example rotation mechanism for a multi-position biased rotating logo component in non-actuated and actuated positions.

FIG. 4 illustrates a perspective view of a second example rotation mechanism 420 for a multi-position biased rotating logo component 402 in non-actuated and actuated positions. In various implementations, the rotation mechanism 420 can be partially or fully hidden within an interior of electronic device 400. The device 400 is depicted in two positions, "Position A" (or "non-actuated") and "Position B" (or "actuated").

Position A depicts the device 400 in a vertical orientation with respect to support surface 406, but not seated within device stand 404. The device 400 slides laterally into the device stand 404, as illustrated by arrow 410 to seat within device stand 404. In Position B, the device stand 404 secures the device 400 in the vertical orientation and actuates the logo component 402 to rotate approximately 90 degrees with reference to device housing 412, to achieve a desired orientation with respect to the support surface 406. Arrow 408 illustrates that the device 400 can be moved back-and-forth between Positions A and B, while repeatedly and automatically achieving the desired logo component orientation in Position B.

The rotation mechanism 420 permits the logo component 402 to rotate with reference to the device housing 412. More specifically, the rotation mechanism 420 includes a spring arm 440 that extends from a fixed spring arm bracket 442 to a logo component arm 426. The logo component arm 426 pivots about pivot point 430 and engages the logo component 402 at component pin 444. The rotation mechanism 420 further includes a pin (or orientation actuator) 422 that projects from the device stand 404. The pin 422 deflects the spring arm 440 when the pin 422 is inserted into the device 400 by engaging and linearly moving a sliding spring arm bracket 446 (not shown in Position B) within the device 400.

More specifically, when moving from Position A to Position B, the pin 422 linearly moves the sliding spring arm bracket 446, thereby deflecting an end of the spring arm 440 attached to the logo component arm 426, as illustrated by arrow 414 in Position B. Deflection of the spring arm 440 rotates the logo component arm 426 clockwise about the pivot point 430. The clockwise movement of the logo component arm 426 is translated to clockwise movement of the logo component 402 via the component pin 444. In various implementations, the rotation mechanism 420 incorporates hard stops (each hard stop associated with one of the orientations) that prevent the logo component 402 from rotating beyond a sector between Position A and Position B.

Dimensions of the logo component 402 are selected such that the logo component 402 is moved from a previous desired logo orientation with respect to the housing 412 (e.g., the logo orientation depicted in Position A) to a new desired logo orientation with respect to the housing 412 (e.g., the logo orientation depicted in Position B), while fitting within allotted space within the housing 412. Movement from Position B to Position A is the opposite of that described above. The two logo orientations depicted in FIG.

4 are about 90 degrees apart. In other implementations, the two logo orientations can be about 180 degrees apart, about 120 degrees apart, or have any other desired angular separation.

In order to promote and/or smooth transitions between orientations of the logo component 402 with respect to the device housing 412, the rotation mechanism can include a self-biasing and/or self-dampening mechanism(s) (not shown). The self-biasing mechanism biases the logo component 402 orientation with respect to the device housing 412 to two or more desired logo component orientations. In one example, the spring arm 440 is preloaded to one orientation. When the stand is assembled, the spring arm 440 is overloaded against the hard stop of the second orientation. For example, the logo component 402 is biased to achieve and hold the logo orientations depicted in Positions A and B of the device 400. When moving between Positions A and B, the logo component 402 holds its orientation up to a point of engagement with the device stand 406 that overcomes the bias that holds the logo component 402 in a current logo component orientation. At that point, an overriding bias moves the logo component 402 quickly and securely to a new logo component orientation. The dampening mechanism dampens movement of the logo component 402 between logo component 402 orientations with respect to the device housing 412. The dampening mechanism makes transitions between the logo orientations depicted in Positions A and B of the device 400 appear smooth and fluid to a user.

Figure 5:
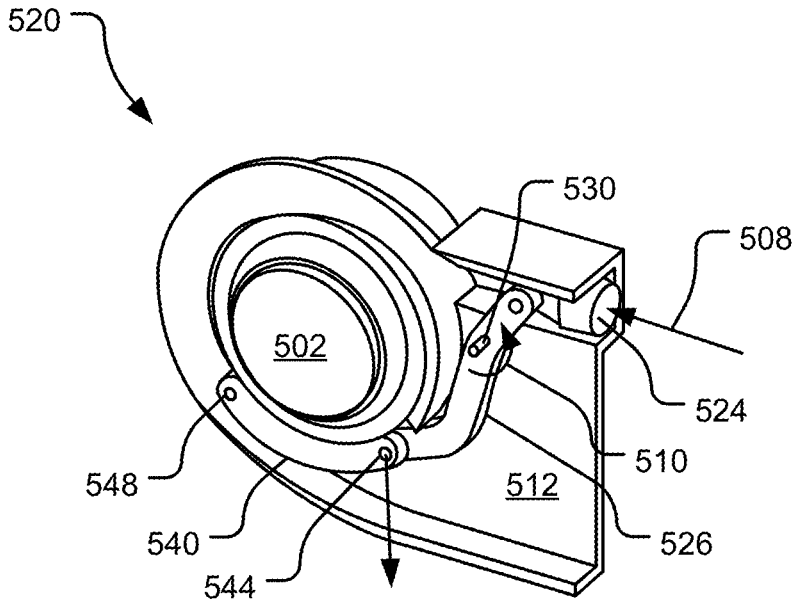
FIG. 5 illustrates a perspective view of a third example rotation mechanism for a multi-position biased rotating logo component.

FIG. 5 illustrates a perspective view of a third example rotation mechanism 520 for a multi-position biased rotating logo component 502. In various implementations, the rotation mechanism 520 can be partially or fully hidden within an interior of an electronic device (not shown). The rotation mechanism 520 permits the logo component 502 to rotate with reference to a device housing 512. More specifically, the rotation mechanism 520 includes a pin or orientation actuator (not shown) that projects from a device stand (also not shown). The pin selectively moves a pad 524 linearly within the rotation mechanism 520, as illustrated by arrow 508. The pad 524 engages a first arm 526, which pivots about pivot point 530, as illustrated by arrow 510, and also engages a second arm 540 at first arm pin 544. The second arm 540 attaches to the logo component 502 at second arm pin 548 and pivots away from the logo component 502, as illustrated by arrow 514, thereby rotating the logo component 502. The rotating logo component 502 can also return to its original position in a manner opposite of that described above.

In various implementations, the rotation mechanism 520 incorporates hard stops that prevent the logo component 502 from rotating beyond a sector between desired logo component 502 orientations. Further, dimensions of the rotation mechanism 520 components are selected such that the logo component 502 is moved between desired logo orientations using a desired stroke of the pad 524, while fitting within allotted space within the housing 512.

In order to promote and/or smooth transitions between orientations of the logo component 502 with respect to the device housing 512, the rotation mechanism 520 can include a biasing and/or dampening mechanism(s) (not shown). The biasing mechanism biases the logo component 502 orientation with respect to the device housing 512 to two or more desired logo component orientations. For example, the logo component 502 is biased to achieve and hold the logo orientation depicted in FIG. 5. When moving away from the position depicted in FIG. 5, the logo component 502 holds its orientation up to a point where an overriding bias moves the logo component 502 quickly and securely to a new logo component orientation. The dampening mechanism dampens movement of the logo component 502 between logo component 502 orientations with respect to the device housing 512. The dampening mechanism makes transitions between logo orientations appear smooth and fluid to a user.

Figure 6:
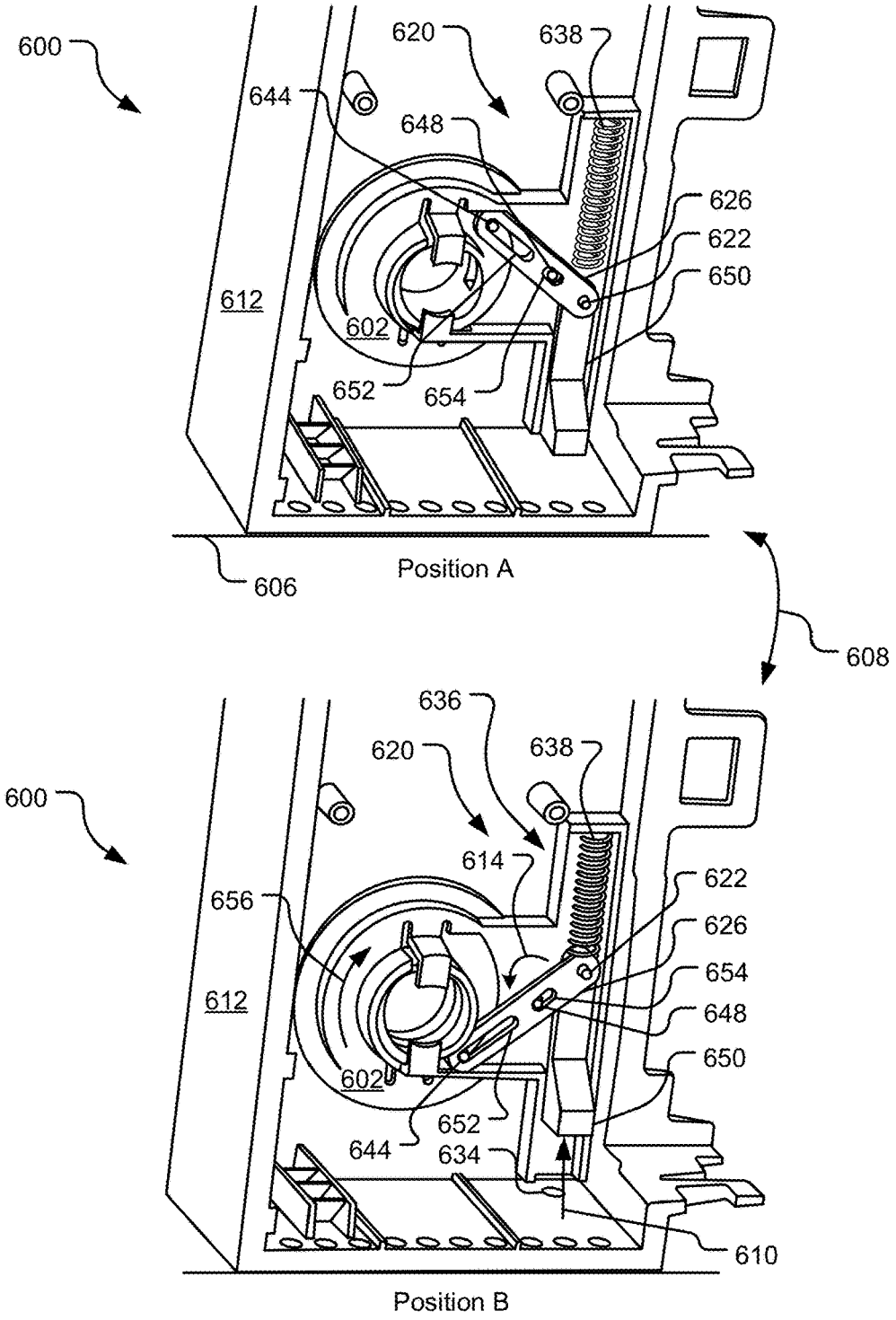
FIG. 6 illustrates a perspective view of a fourth example rotation mechanism for a multi-position biased rotating logo component in non-actuated and actuated positions.

FIG. 6 illustrates a perspective view of a fourth example rotation mechanism 620 for a multi-position biased rotating logo component 602 in non-actuated and actuated positions. In various implementations, the rotation mechanism 620 can be partially or fully hidden within an interior of electronic device 600. The device 600 is depicted in two positions, "Position A" (or "non-actuated") and "Position B" (or "actuated").

Position A depicts the device 600 in a vertical orientation with respect to support surface 606, but not seated within a device stand (not shown). In Position B, the device stand secures the device 600 in the vertical orientation and actuates the logo component 602 to rotate approximately 90 degrees with reference to device housing 612 to achieve a desired orientation with respect to the support surface 606. Arrow 608 illustrates that the device 600 can be moved back-and-forth between Positions A and B, while repeatedly and automatically achieving the desired logo component orientation in Position B.

The rotation mechanism 620 permits the logo component 602 to rotate with reference to the device housing 612. More specifically, the rotation mechanism 620 includes a post 650, one end of which is connected to arm 626 at post pin 622. The arm 626 pivots about pin 648, which projects from the device housing 612, and is connected to the logo component 602 at component pin 644. The arm 626 includes slots 652, 654, which permit the arm 626 to move both rotationally and slideably with reference to the pins 644, 648, respectively.

More specifically, when moving from Position A to Position B, a device stand pin or orientation actuator (not shown) protrudes into the device 600 via aperture 634 linearly depressing the post 650 as illustrated by arrow 610. The post 650 linearly deflects the arm 626 at the post pin 622, which rotates the arm 626 counterclockwise about the pin 648, as illustrated by arrow 614. The arm 626 also moves linearly within the slot 654 to accommodate a changing linear distance between the pins 622, 648 as the post 650 and corresponding post pin 622 linearly deflect and the pin 648 remains stationary. Rotating the arm 626 about the pin 648 rotates the logo component 602 clockwise via component pin 644, as illustrated by arrow 656, to achieve Position B of the logo component 602. The pin 644 also moves linearly within the slot 652 to accommodate a changing linear distance between the pins 644, 648 as the pin 644 rotates and the pin 648 remains stationary.

In various implementations, the rotation mechanism 620 incorporates hard stops that prevent the logo component 602 from rotating beyond a sector between Position A and Position B. The rotating logo component 602 can also return to its original position in a manner opposite of that described above. Further, dimensions of the logo component 602 components are selected such that the logo component 602 is moved from a previous desired logo orientation with respect to the housing 612 (e.g., the logo orientation depicted in Position A) to a new desired logo orientation with respect to the housing 612 (e.g., the logo orientation depicted in Position B), while fitting within allotted space within the housing 612. The two logo orientations depicted in FIG. 6 are about 90 degrees apart. In other implementations, the two logo orientations can be about 180 degrees apart, about 120 degrees apart, or have any other desired angular separation.

In order to promote and/or smooth transitions between orientations of the logo component 602 with respect to the device housing 612, the rotation mechanism 620 can include a biasing and/or dampening mechanism 636. The mechanism 636 biases the logo component 602 orientation with respect to the device housing 612 to one or both of the two depicted desired logo component orientations. More specifically, the mechanism 636 includes a spring 638 that pushes the logo component 602 toward one or both of the two depicted desired logo component orientations and away from any other logo orientations.

For example, the logo component 602 is biased to achieve and hold the logo orientations depicted in Positions A and B of the device 600. When moving from Position A to Position B, the logo component 602 resists rotation up to a point of engagement with the device stand that overcomes the bias that holds the logo component 602 in the logo component orientation of Position A. At that point, an overriding bias moves the logo component 602 quickly and securely to the logo component orientation depicted in Position B. The mechanism 636 can also dampen movement of the logo component 602 between logo component 602 orientations with respect to the device housing 612, thus making transitions between the logo orientations depicted in Positions A and B of the device 600 appear smooth and fluid to a user.

Figure 7:
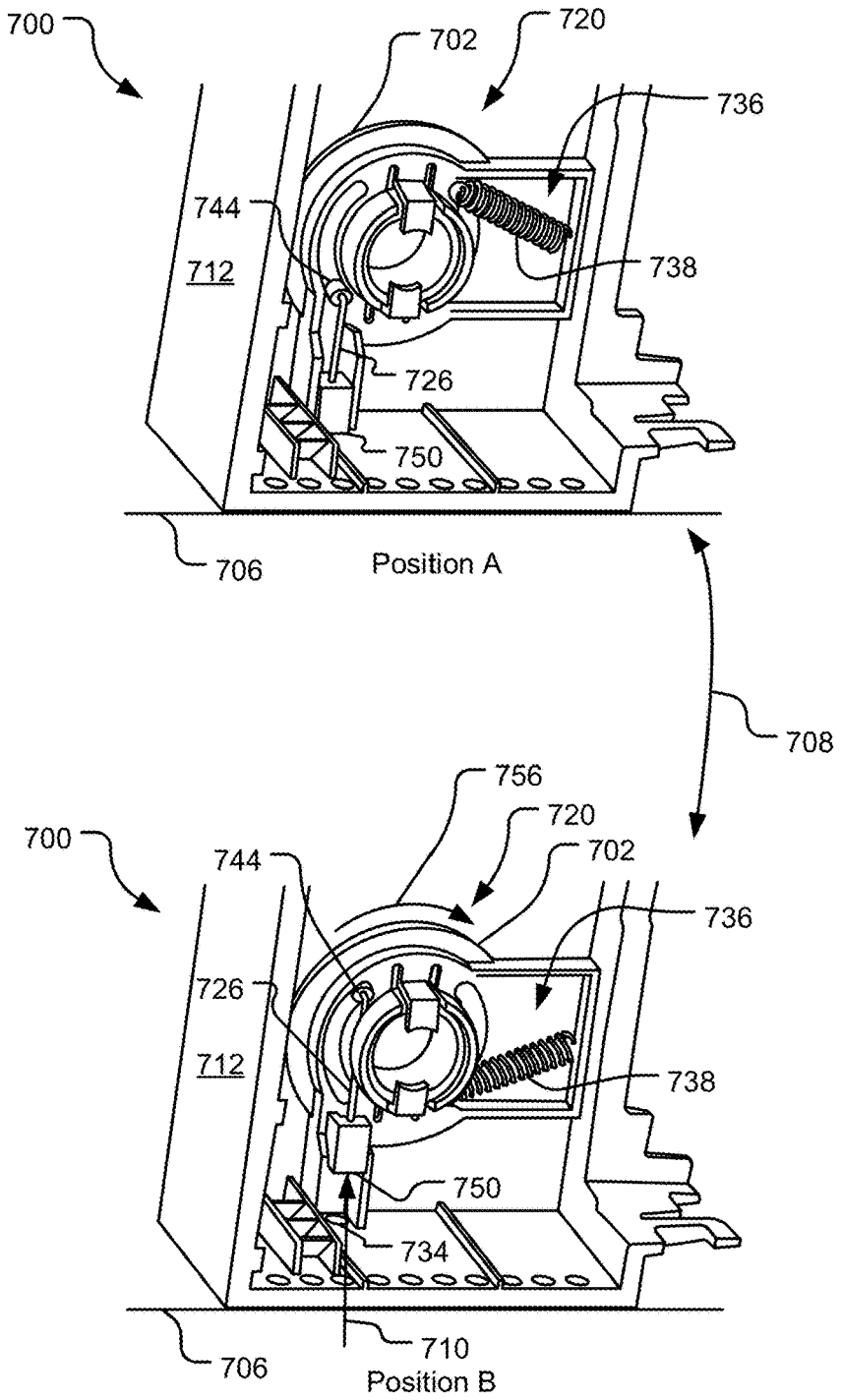
FIG. 7 illustrates a perspective view of a fifth example rotation mechanism for a multi-position biased rotating logo component in non-actuated and actuated positions.

FIG. 7 illustrates a perspective view of a fifth example rotation mechanism 720 for a multi-position biased rotating logo component 702 in non-actuated and actuated positions. In various implementations, the rotation mechanism 720 can be partially or fully hidden within an interior of electronic device 700. The device 700 is depicted in two positions, "Position A" (or "non-actuated") and "Position B" (or "actuated").

Position A depicts the device 700 in a vertical orientation with respect to support surface 706, but not seated within a device stand (not shown). In Position B, the device stand secures the device 700 in the vertical orientation and actuates the logo component 702 to rotate approximately 90 degrees with reference to device housing 712 to achieve a desired orientation with respect to the support surface 706. Arrow 708 illustrates that the device 700 can be moved back-and-forth between Positions A and B, while repeatedly and automatically achieving the desired logo component orientation in Position B.

The rotation mechanism 720 permits the logo component 702 to rotate with reference to the device housing 712. More specifically, the rotation mechanism 720 includes a post 750, one end of which is connected to arm 726. The arm 726 is connected to the logo component 702 at component pin 744. When moving from Position A to Position B, a device stand pin or orientation actuator (not shown) protrudes into the device 700 via aperture 734 linearly depressing the post 750 as illustrated by arrow 710. The post 750 deflects the arm 726, which in turn rotates the logo component 702 clockwise via component pin 744, as illustrated by arrow 756, to achieve Position B of the logo component 702. Further, the arm 726 can be resiliently deflectable and/or the arm 726 can hinge with respect to the post 750 in order to accommodate the arced movement of the pin 744 as the device 700 is moved from Position A to Position B.

In various implementations, the rotation mechanism 720 incorporates hard stops that prevent the logo component 702 from rotating beyond a sector between Position A and Position B. The rotating logo component 702 can also return to its original position in a manner opposite of that described above. Further, dimensions of the logo component 702 components are selected such that the logo component 702 is moved from a previous desired logo orientation with respect to the housing 712 (e.g., the logo orientation depicted in Position A) to a new desired logo orientation with respect to the housing 712 (e.g., the logo orientation depicted in Position B), while fitting within allotted space within the housing 712. The two logo orientations depicted in FIG. 7 are about 90 degrees apart. In other implementations, the two logo orientations can be about 180 degrees apart, about 120 degrees apart, or have any other desired angular separation.

In order to promote and/or smooth transitions between orientations of the logo component 702 with respect to the device housing 712, the rotation mechanism 720 can include a biasing and/or dampening mechanism 736. The mechanism 736 biases the logo component 702 orientation with respect to the device housing 712 to one or both of the two depicted desired logo component orientations. More specifically, the mechanism 736 includes a spring 738 that pushes the logo component 702 toward one or both of the two depicted desired logo component orientations and away from any other logo orientations.

For example, the logo component 702 is biased to achieve and hold the logo orientations depicted in Positions A and B of the device 700. When moving from Position A to Position B, the logo component 702 resists rotation up to a point of engagement with the device stand that overcomes the bias that holds the logo component 702 in the logo component orientation of Position A. At that point, an overriding bias moves the logo component 702 quickly and securely to the logo component orientation depicted in Position B. The mechanism 736 can also dampen movement of the logo component 702 between logo component 702 orientations with respect to the device housing 712, thus making transitions between the logo orientations depicted in Positions A and B of the device 700 appear smooth and fluid to a user.

Figure 8:
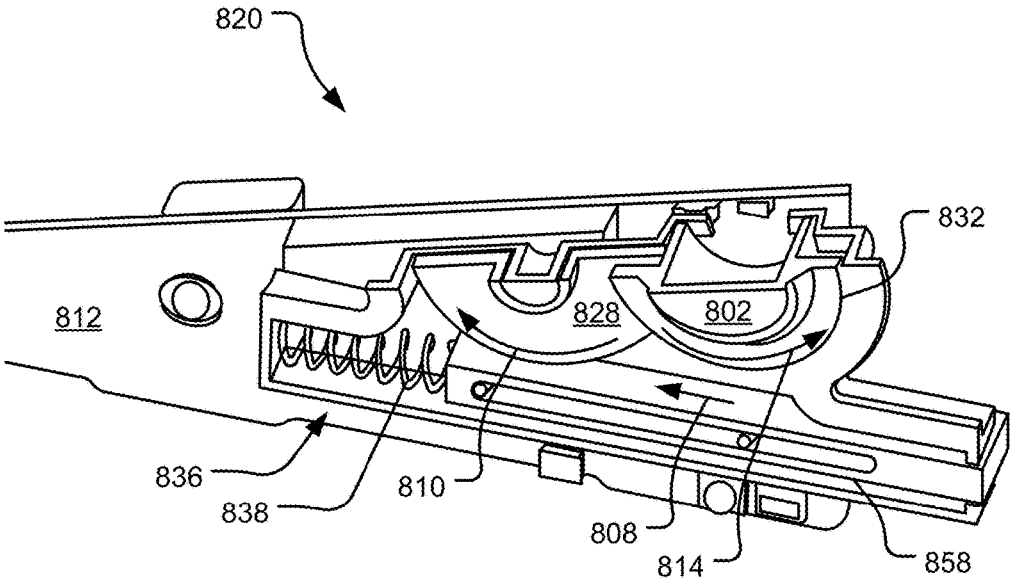
FIG. 8 illustrates a perspective view of a sixth example rotation mechanism for a multi-position biased rotating logo component.

FIG. 8 illustrates a perspective view of a sixth example rotation mechanism 820 for a multi-position biased rotating logo component 802. In various implementations, the rotation mechanism 820 can be partially or fully hidden within an interior of an electronic device (not shown). The rotation mechanism 820 permits the logo component 802 to rotate with reference to a device housing 812. More specifically, the rotation mechanism 820 includes a pin or orientation actuator (not shown) that projects from a device stand (also not shown).

The pin selectively moves a rack 858 linearly within the rotation mechanism 820, as illustrated by arrow 808. The rack 858 engages a pinion gear 828 (rack-and-pinion teeth are omitted for clarity), which rotates clockwise, as illustrated by arrow 810. The pinion gear 828 engages a component gear 832 (component gear teeth are also omitted for clarity), which rotates counterclockwise, as illustrated by arrow 814. The rotating logo component 802 can also return to its original position in a manner opposite of that described above.

In various implementations, the rotation mechanism 820 incorporates hard stops that prevent the logo component 802 from rotating beyond a sector between desired logo component 802 orientations. Further, dimensions of the rotation mechanism 820 components are selected such that the logo component 802 is moved between desired logo orientations using a desired stroke of the rack 858, while fitting within allotted space within the housing 812.

In order to promote and/or smooth transitions between orientations of the logo component 802 with respect to the device housing 812, the rotation mechanism 820 can include a biasing and/or dampening mechanism 836. The mechanism 836 biases the logo component 802 orientation with respect to the device housing 812 to two or more desired logo component orientations. More specifically, the mechanism 836 includes a spring 838 that pushes the logo component 802 toward one or both of the two depicted desired logo component orientations and away from any other logo orientations.

For example, the logo component 802 is biased to achieve and hold the logo orientation depicted in FIG. 8. When moving away from the position depicted in FIG. 8, the logo component 802 holds its orientation up to a point where an overriding bias moves the logo component 802 quickly and securely to a new logo component orientation. The mechanism 836 can also dampen movement of the logo component 802 between logo component 802 orientations with respect to the device housing 812. The dampening mechanism makes transitions between logo orientations appear smooth and fluid to a user.

Figure 9:
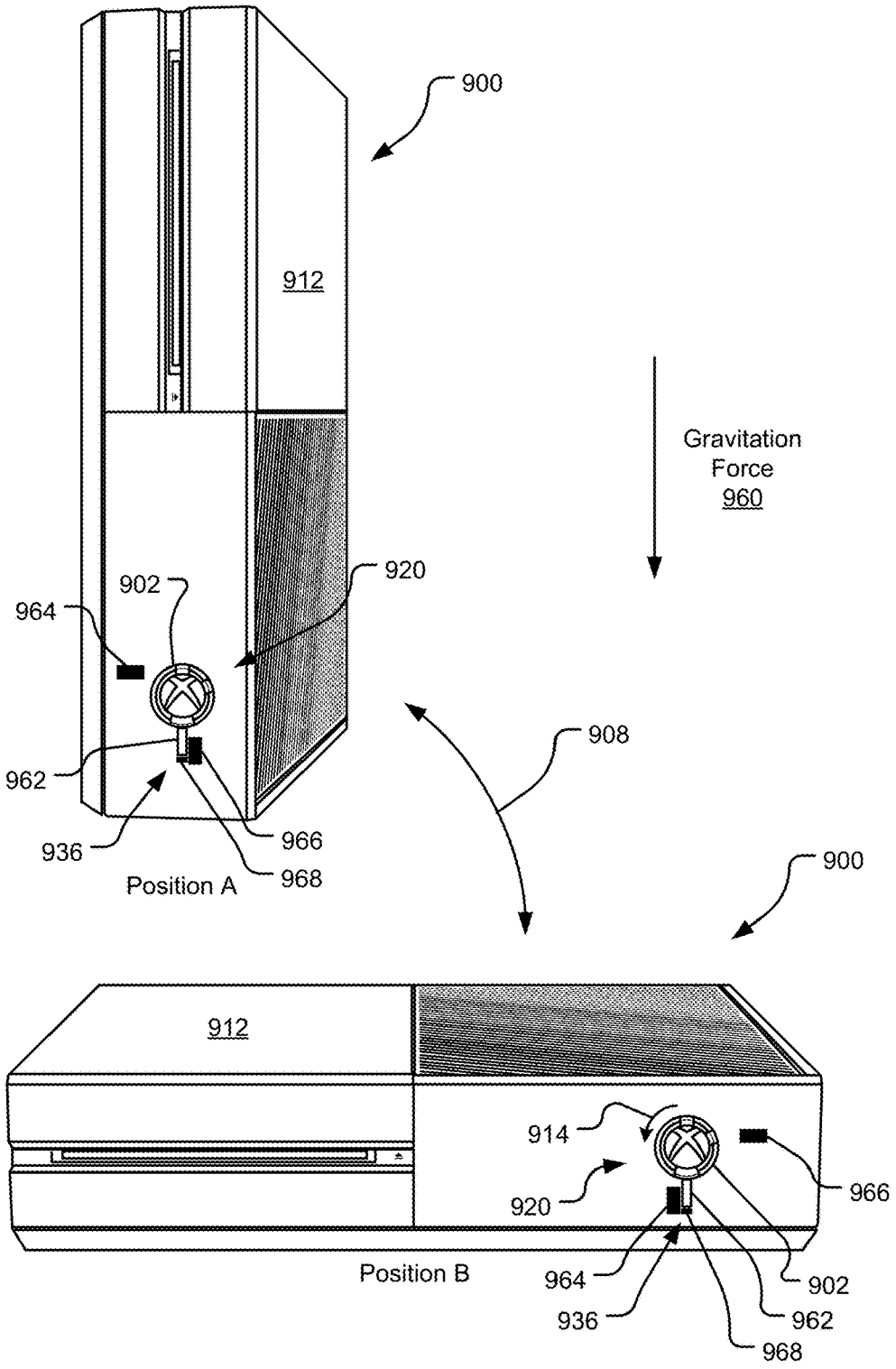
FIG. 9 illustrates an electronic device with a first example multi-position biased rotating logo component actuated by rotating the electronic device.

FIG. 9 illustrates an electronic device 900 with a first example multi-position biased rotating logo component 902 actuated by rotating the electronic device 900. Device 900 is depicted in two positions, "Position A" and "Position B." Position A depicts the device 900 at rest in a vertical orientation and the logo component 902 is oriented at a desired orientation with respect to a direction of gravitational force 960. As illustrated by arrow 908, the device 900 can be moved to Position B, which places the device 900 in a horizontal orientation and the logo component 902 rotates approximately 90 degrees with reference to device housing 912, as illustrated by arrow 914, to again achieve the desired orientation with respect to the direction of gravitational force 960.

The device 900 includes a rotation mechanism 920 that permits the logo component 902 to rotate with reference to the device housing 912. In various implementations, the rotation mechanism 920 can be partially or fully hidden within an interior of the device 900. The rotation mechanism 920 includes a weight 962 attached to one side of the logo component 902 where the logo component 902 is in the desired orientation when the weight 962 hangs from the logo component 902 in the direction of gravitational force 960. As a result, as the device 900 is re-positioned, the rotation mechanism 920 re-orients the logo component 902 to the desired orientation. Arrow 908 illustrates that the device 900 can be moved back-and-forth between Positions A and B, while repeatedly and automatically achieving the desired logo component orientation in Positions A and B.

The rotation mechanism 920 incorporates hard stops 964, 966 that prevent the logo component 902 from rotating beyond a sector between the desired logo component 902 orientations. Further, dimensions of the rotation mechanism 920 components are selected such that the logo component 902 is moved between desired logo orientations while fitting within allotted space within the housing 912.

In order to promote and/or smooth transitions between orientations of the logo component 902 with respect to the device housing 912, the rotation mechanism 920 includes a biasing and/or dampening mechanism 936. The mechanism 936 biases the logo component 902 orientation with respect to the device housing 912 to one or both of the two depicted desired logo component orientations. More specifically, the mechanism 936 includes a magnet 968 attached to a distal end of the weight 962 and the hard stops 964, 966 are ferromagnetic. As a result, as the weight 962 nears one of the hard stops 964, 966 by force of gravity, the weight 962 is attracted to and held in place adjacent the hard stop.

More specifically, the logo component 902 is biased to achieve and hold the logo orientations depicted in Positions A and B of the device 900. When moving from Position A to Position B, the logo component 902 resists rotation up to a point where the gravitational force 960 exceeds the magnetic force that acts as a bias holding the weight 962 against the hard stop 966, as illustrated in Position A. At that point, the overriding gravitational force 960 moves the logo component 902 quickly and securely to the logo component orientation depicted in Position B. A magnetic force that acts as a bias holding the weight 962 against the hard stop 964 secures the logo component in the orientation depicted in Position B. The mechanism 936 can also dampen movement of the logo component 902 between logo component 902 orientations with respect to the device housing 912, thus making transitions between the logo orientations depicted in Positions A and B of the device 900 appear smooth and fluid to a user.

In another implementation, the weight 962 itself is a magnet, thus omitting the need for the separate magnet 968. In other implementations, the hard stops 964, 966 are magnets and the weight 962 is ferromagnetic or incorporates a ferromagnetic component. In still further implementations, the hard stops 964, 966 are repositioned so that they do not physically contact the weight 962 and/or magnet 962 in any of the desired logo component 902 orientations, but rather act as stops and biasing components when the weight 962 comes in close proximity to the hard stops 964, 966 by virtue of magnetic attraction alone. In still other implementations, the magnet 962 and/or the hard stops 964, 966 are replaced with physical detents (not shown) in the housing 912 that correspond with the desired logo component 902 orientations. The weight 962 rotates into and out of the detents, which act as stops and biasing components for the rotation mechanism 920.

In yet another implementation, using magnets as weights can allow rotational stops at a large variety of orientations (e.g., 0°, 90°, 180°, 270°, 45°, etc.)

Figure 10:
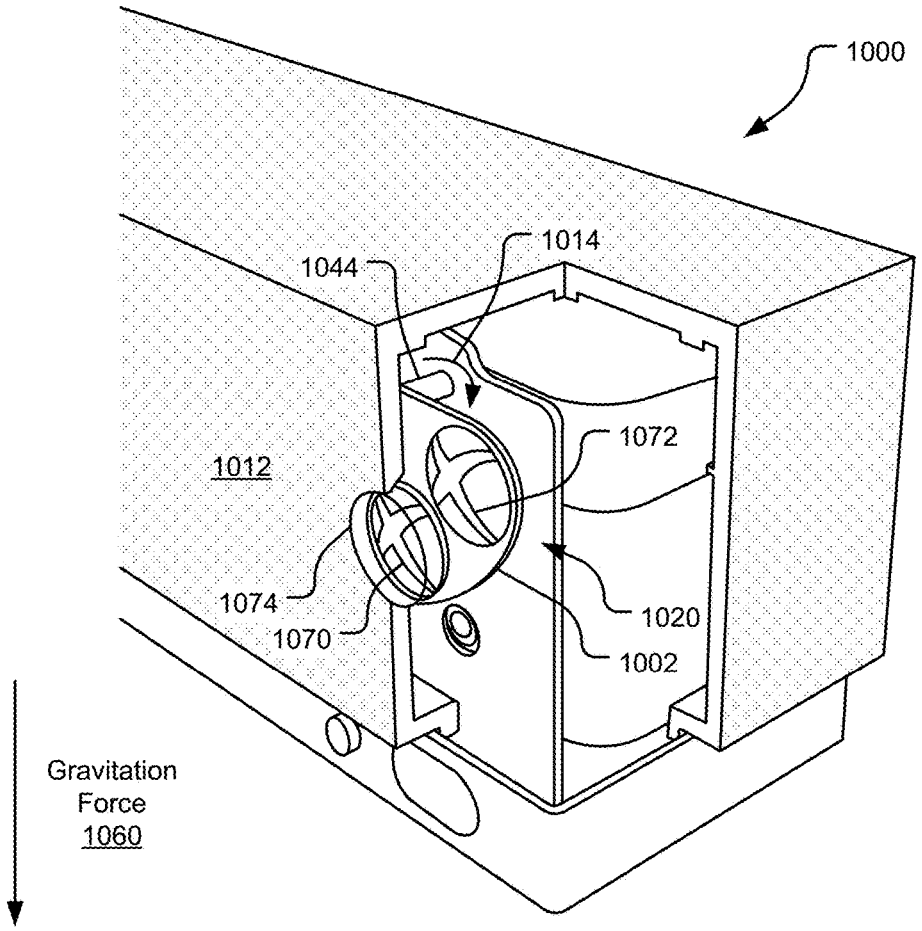
FIG. 10 illustrates an electronic device with a second example multi-position biased rotating logo component actuated by rotating the electronic device.

FIG. 10 illustrates an electronic device 1000 with a second example multi-position biased rotating logo component 1002 actuated by rotating the electronic device 1000. The device 1000 is depicted at rest in a horizontal orientation and has a cut-out illustrating a rotation mechanism 1020 that permits the logo component 1002 to rotate with reference to a device housing 1012. The rotation mechanism 1020 can be partially or fully hidden within an interior of the device 1000.

The logo component 1002 is oriented at a desired orientation with respect to a direction of gravitational force 1060. The device 1000 can be moved to a vertical orientation (not shown), where the logo component 1002 rotates approximately 90 degrees with reference to device housing 1012, as illustrated by arrow 1014, to again achieve the desired orientation with respect to the direction of gravitational force 1060. The device 1000 can be moved back-and-forth between the horizontal and vertical orientations (and any other desired device 1000 orientations), while repeatedly and automatically achieving the corresponding desired logo component orientation.

The rotation mechanism 1020 includes the logo component 1002, which in turn includes multiple logo images, each of which correspond to a desired logo component orientation. Here, there are two logo images 1070, 1072, and thus two desired logo component orientations. The logo component 1002 pivots about component pin 1044 to selectively display one of the two logo images 1070, 1072 through a window 1074 in the device housing 1012.

More specifically, the logo component 1002 is weighted such that logo 1070 extends in the direction of the gravitational force 1060. In the depicted horizontal orientation, the logo image 1070 is visible through the window 1074 in the device housing 1012. As the device 1000 is re-positioned to the vertical position, the logo component 1002 rotates clockwise by virtue of the gravitational force 1060, as illustrated by arrow 1014 and logo image 1072 becomes visible through the window 1074 in the device housing 1012.

The rotation mechanism 1020 can incorporate hard stops that prevent the logo component 1002 from rotating beyond a sector between the desired logo component 1002 orientations. Further, dimensions of the rotation mechanism 1020 components are selected such that the logo component 1002 is moved between desired logo orientations while fitting within allotted space within the housing 1012.

In order to promote and/or smooth transitions between orientations of the logo component 1002 with respect to the device housing 1012, the rotation mechanism can include a biasing and/or dampening mechanism(s) (not shown). The biasing mechanism biases the logo component 1002 orientation with respect to the device housing 1012 to two or more desired logo component orientations. For example, the logo component 1002 is biased to achieve and hold the horizontal and vertical logo component 1002 orientations. When moving between orientations, the logo component 1002 holds its orientation up to a point where an overriding bias moves the logo component 1002 quickly and securely to a new logo component orientation. The dampening mechanism dampens movement of the logo component 1002 between logo component 1002 orientations with respect to the device housing 1012. The dampening mechanism makes transitions between the logo orientations appear smooth and fluid to a user.

Figure 11:
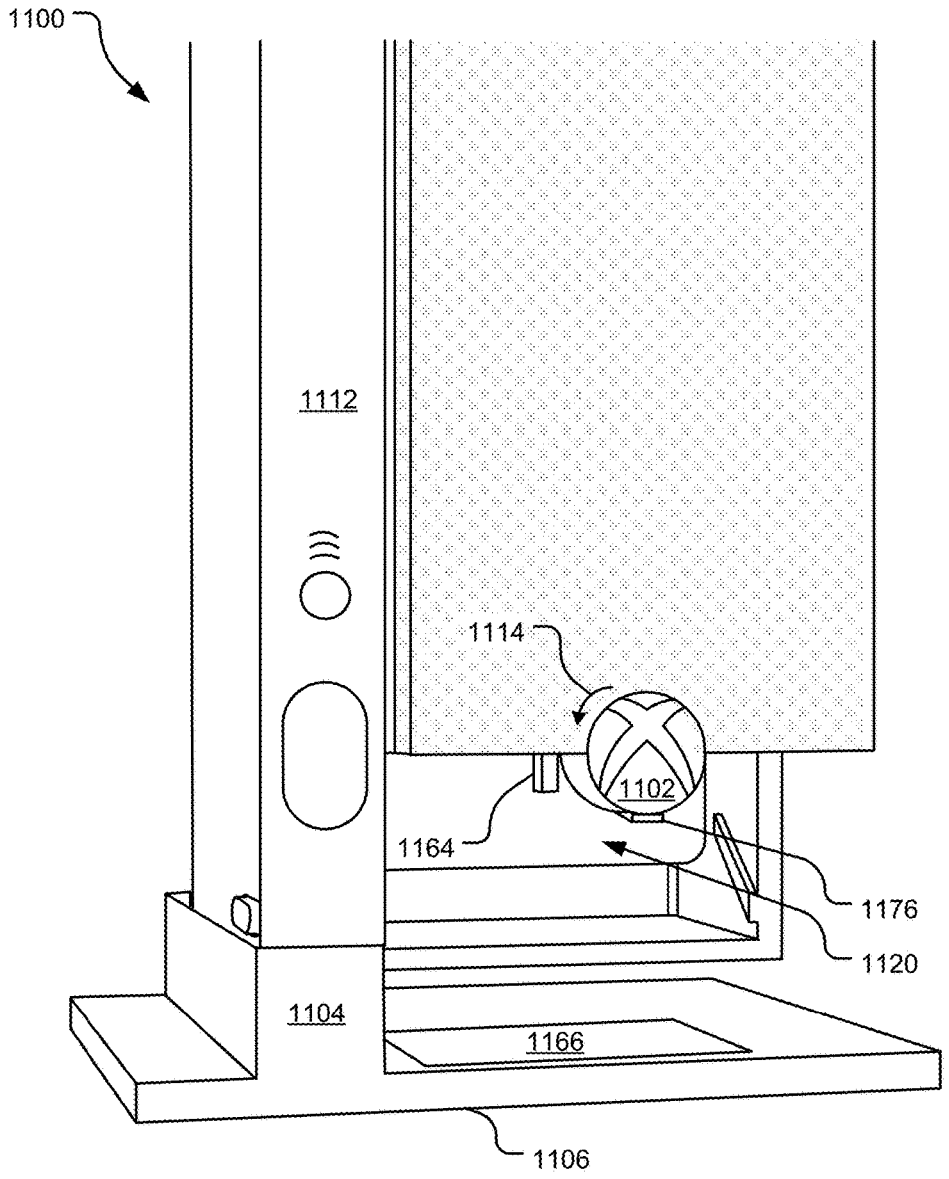
FIG. 11 illustrates an electronic device with an example magnetically-actuated multi-position biased rotating logo component.

FIG. 11 illustrates an electronic device 1100 with an example magnetically-actuated multi-position biased rotating logo component 1102. The device 1100 is depicted at rest in a vertical orientation and seated on a device stand 1104. The device 1100 and/or the device stand 1104 has a cut-out illustrating a rotation mechanism 1120 that permits the logo component 1102 to rotate with reference to a device housing 1112. The rotation mechanism 1120 can be partially or fully hidden within an interior of the device 1100.

The logo component 1102 is oriented at a desired orientation with respect to a support surface 1106. The device stand 1104 can be removed and the device 1100 can be moved to a horizontal orientation (not shown), where the logo component 1102 rotates approximately 90 degrees with reference to the device housing 1112, as illustrated by arrow 1114, to again achieve the desired orientation with respect to the support surface 1106. The device 1100 can be moved back-and-forth between the horizontal and vertical orientations (and any other desired device 1100 orientations), while repeatedly achieving the corresponding desired logo component orientation.

The rotation mechanism 1120 includes the logo component 1102, which has a ferromagnetic feature 1176 located at a discrete location on the logo component 1102 outer surface. The rotation mechanism 1120 further includes magnets 1164, 1166, one of which (i.e., housing magnet 1164) is mounted to the device housing 1112 and the other of which (i.e., stand magnet 1166) is mounted to the device stand 1104. The magnet 1164 has a weak magnetic attraction to the ferromagnetic feature 1176 as compared to the magnetic attraction of the magnet 1166 to the ferromagnetic feature 1176.

While the device 1100 is mounted to the device stand 1104, the relatively strong magnetic attraction between the stand magnet 1166 and the ferromagnetic feature 1176 aligns the logo component 1102 in the depicted desired logo orientation for a vertical orientation of the device. When the device stand 1104 is removed from the device 1100, the relatively weak magnetic attraction between the housing magnet 1164 and the ferromagnetic feature 1176 aligns the logo component 1002 in desired logo orientation for a horizontal orientation of the device 1100.

The rotation mechanism 1120 can incorporate hard stops that prevent the logo component 1102 from rotating beyond a sector between the desired logo component 1102 orientations. Further, dimensions of the rotation mechanism 1120 components are selected such that the logo component 1102 is moved between desired logo orientations while fitting within allotted space within the housing 1112.

In order to promote and/or smooth transitions between orientations of the logo component 1102 with respect to the device housing 1112, the rotation mechanism 1120 can include biasing and/or dampening mechanism(s). The biasing mechanism biases the logo component 1102 orientation with respect to the device housing 1112 to two or more desired logo component orientations. For example, the magnets 1164, 1166 bias the logo component 1102 to achieve and hold the horizontal and vertical logo component 1102 orientations. When moving between orientations, the logo component 1102 holds its orientation up to a point where an overriding bias moves the logo component 1102 quickly and securely to a new logo component orientation. The dampening mechanism dampens movement of the logo component 1102 between logo component 1102 orientations with respect to the device housing 1112. The dampening mechanism makes transitions between the logo orientations appear smooth and fluid to a user.

In other implementations, the magnets 1164, 1166 are instead ferromagnetic and the ferromagnetic feature 1176 is instead magnetic. In still further implementations, the magnets 1164, 1166 and the ferromagnetic feature 1176 act as hard stops act as stops and biasing components by virtue of magnetic attraction alone.

Figure 12:
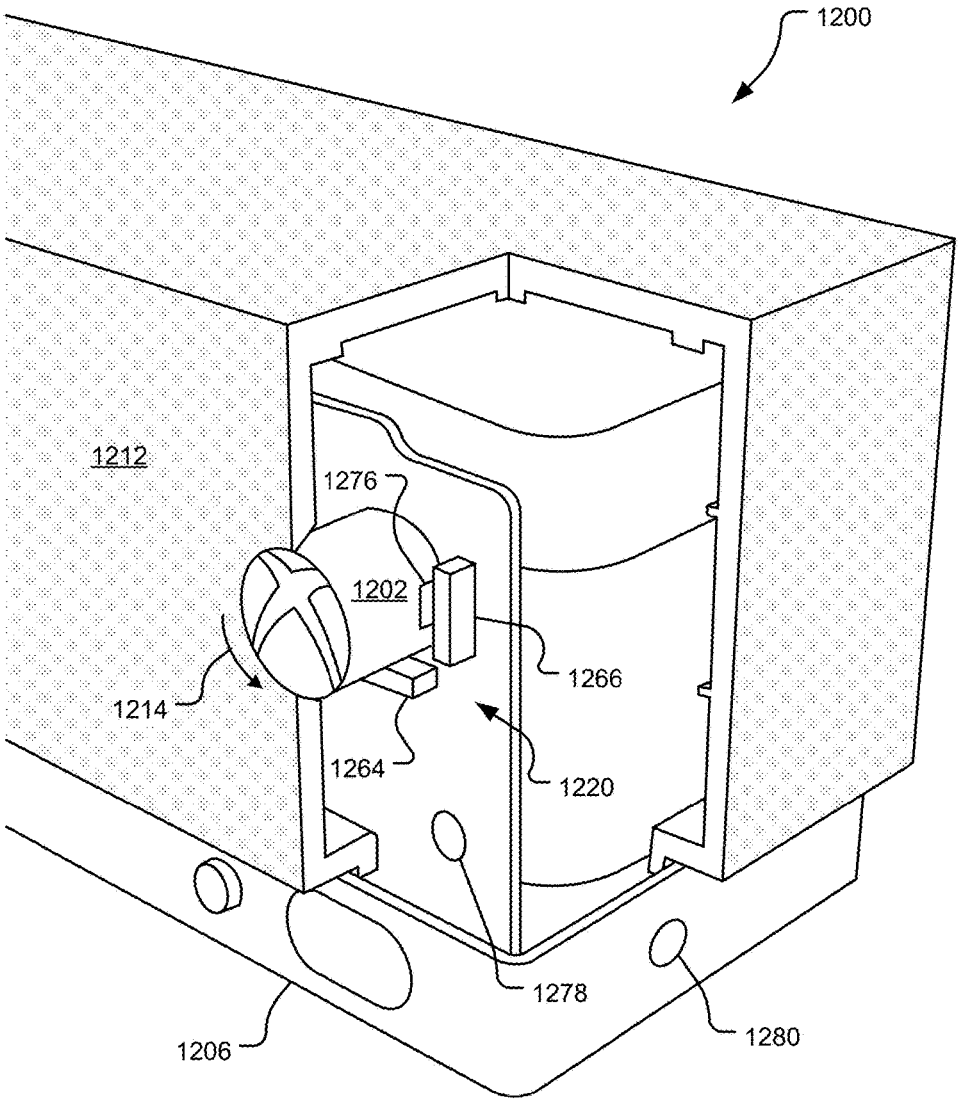
FIG. 12 illustrates an electronic device with an example electromagnetically-actuated multi-position biased rotating logo component.

FIG. 12 illustrates an electronic device 1200 with an example electromagnetically-actuated multi-position biased rotating logo component 1202. The device 1200 is depicted at rest in a horizontal orientation and has a cut-out illustrating a rotation mechanism 1220 that permits the logo component 1202 to rotate with reference to a device housing 1212. The rotation mechanism 1220 can be partially or fully hidden within an interior of the device 1200.

The logo component 1202 is oriented at a desired orientation with respect to a support surface 1206. The device 1200 can be moved to a vertical orientation (not shown), where the logo component 1202 rotates approximately 90 degrees with reference to the device housing 1212, as illustrated by arrow 1214, to again achieve the desired orientation with respect to the support surface 1206. The device 1200 can be moved back-and-forth between the horizontal and vertical orientations (and any other desired device 1200 orientations), while repeatedly achieving the corresponding desired logo component orientation.

The rotation mechanism 1220 includes the logo component 1202, which has a ferromagnetic feature 1276 located at a discrete location on the logo component 1202 outer surface. The rotation mechanism 1220 further includes electromagnets 1264, 1266 mounted to the device housing 1212 at two orientations that correspond to the desired logo component orientations. The electromagnets 1264, 1266 are selectively powered depending upon what orientation that the device 1200 is placed.

In some implementations, an orientation sensor 1278 (e.g., an accelerometer, ball switch, or other gravity-actuated switch) provides a control signal to the electromagnets 1264, 1266 to define which is selectively powered. In other implementations, a proximity or contact sensor 1280 is included on one or more exterior surfaces of the device 1200 to define which electromagnet is selectively powered. In still further implementations, the control signal to the electromagnets 1264, 1266 is manually controlled.

The rotation mechanism 1220 can incorporate hard stops that prevent the logo component 1202 from rotating beyond a sector between the desired logo component 1202 orientations. Further, dimensions of the rotation mechanism 1220 components are selected such that the logo component 1202 is moved between desired logo orientations while fitting within allotted space within the housing 1212.

In order to promote and/or smooth transitions between orientations of the logo component 1202 with respect to the device housing 1212, the rotation mechanism 1220 can include biasing and/or dampening mechanism(s). The biasing mechanism biases the logo component 1202 orientation with respect to the device housing 1212 to two or more desired logo component orientations. For example, the magnets 1264, 1266 bias the logo component 1202 to achieve and hold the horizontal and vertical logo component 1202 orientations. When moving between orientations, the logo component 1202 holds its orientation up to a point where an overriding bias moves the logo component 1202 quickly and securely to a new logo component orientation. The dampening mechanism dampens movement of the logo component 1202 between logo component 1202 orientations with respect to the device housing 1212. The dampening mechanism makes transitions between the logo orientations appear smooth and fluid to a user.

In other implementations, the magnets 1264, 1266 are instead ferromagnetic and the ferromagnetic feature 1276 is instead magnetic. In still further implementations, the magnets 1264, 1266 and the ferromagnetic feature 1276 act as hard stops act as stops and biasing components by virtue of magnetic attraction alone.

In further yet implementations, the rotation mechanism 1220 is electro-mechanically, rather than electro-magnetically actuated. For example, the magnets 1264, 1266 and the ferromagnetic feature 1276 can be replaced by a servo motor and in some implementations, planetary and/or worm gears that drive rotation of the logo component 1202 to a desired logo component orientation. Still further, some or all of the electro-mechanical components can be incorporated into one or both of the device 1200 and a device stand (not shown). In other examples, the magnets 1264, 1266 and the ferromagnetic feature 1276 can be replaced by a linear motor, a standard electric motor, a solenoid, a nitinol wire, a nanomuscle, a piezoelectric element, etc.

Figure 13:
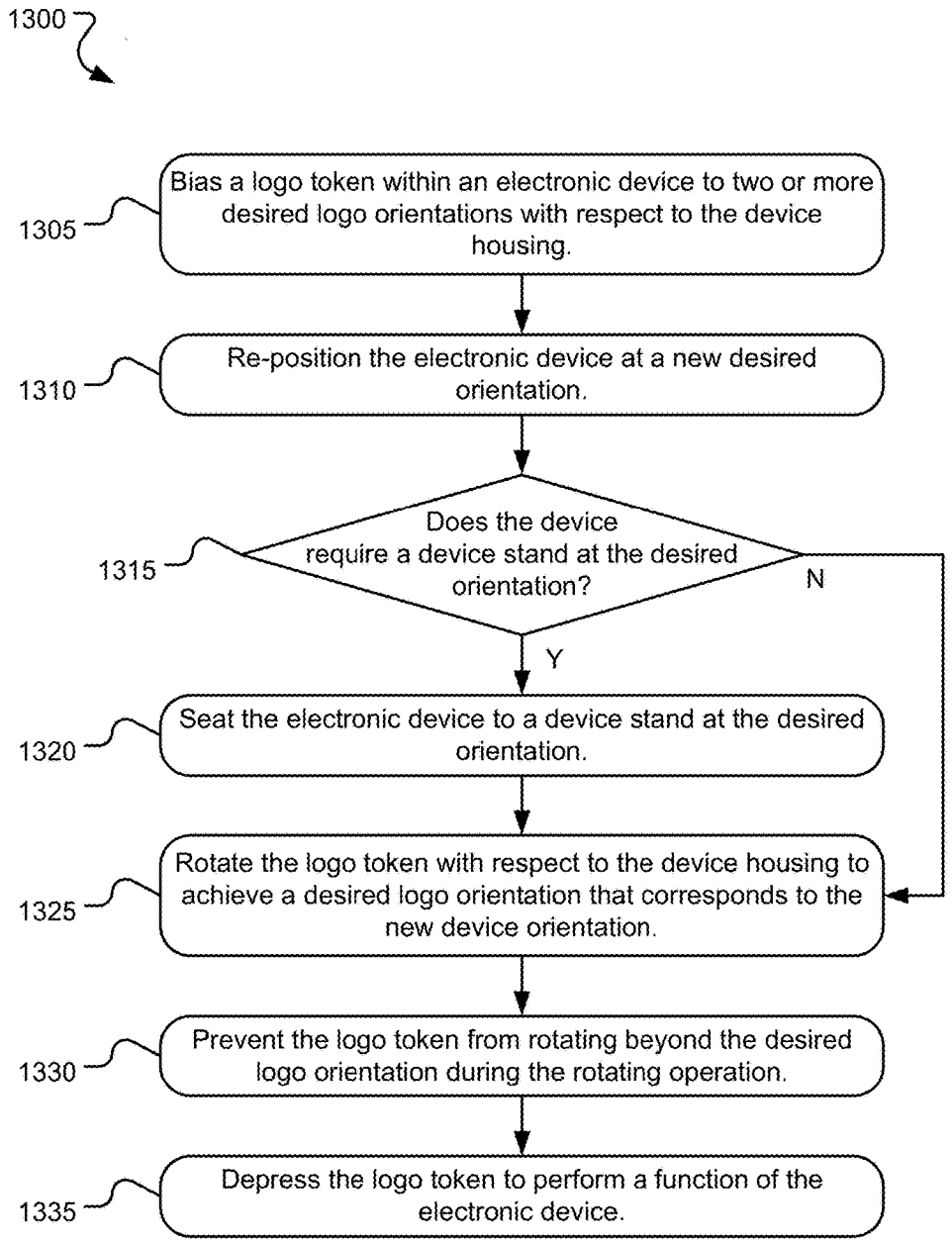
FIG. 13 illustrates example operations for using a multi-position biased rotating logo component mounted within an electronic device.

FIG. 13 illustrates example operations 1300 for using a multi-position biased rotating logo component mounted within an electronic device. A biasing operation 1305 biases a logo component within an electronic device to two or more desired logo orientations with respect to the device housing. In some implementations, the logo orientations correspond to horizontal and vertical orientations of the electronic device, wherein the logo component rotates within the device housing. The bias can be generated mechanically, electrically, magnetically, electrostatically, etc., and it exists to ensure that the logo component achieves and maintains a precise desired orientation within the device housing. In some implementations, the biasing operation 1305 can also dampen rotation of the logo component.

A re-positioning operation 1310 re-positions the electronic device at a new desired orientation (e.g., horizontal or vertical). The new selected orientation can be based on space constraints for the electronic device, user personal preference, or any other rationale for selecting an orientation for the device. Decision operation 1315 determines if the device requires a device stand at the desired orientation. For example, the device can require a stand for stability purposes when it is positioned in a vertical orientation, but no stand when it is positioned in a horizontal orientation. In other implementations, the device requires a stand for all orientations.

If the device requires a device stand, a seating operation 1320 seats the electronic device to the device stand that is placed at the desired device orientation. In various implementations, the device slides vertically and/or horizontally into place on or within the device stand and the device stand securely holds the device in place on or within the stand and in the new desired orientation. If the device does not require a device stand, the device is merely placed on a support surface in the desired orientation in the re-positioning operation 1310.

A rotating operation 1325 rotates the logo component with respect to the device housing to achieve a desired logo orientation that corresponds to the new device orientation. The rotating operation 1325 can be triggered by a variety of mechanisms. In some implementations, a mechanical linkage between the device and the device stand causes the rotating operation 1325 to occur as the device is seated to the stand. In other implementations, a proximity or contact sensor (electronic or mechanical) on the device detects the presence of a support surface and causes the rotating operation 1325 to occur as the device is placed on the support surface. In further implementations, any one or more of a gravity-based system, magnetic contact system, an electromagnetic system, and an electro-mechanical system causes the rotating operation 1325 to occur.

A preventing operation 1330 prevents the logo component from rotating beyond the desired logo orientation during the rotating operation 1325. The preventing operation 1330 can be accomplished by use of mechanical stops, magnetic or electro-magnetic stops, and/or servo motors stops, for example. A depressing or actuating operation 1335 depresses or detects a depressing of the logo component to perform a function of the electronic device. For example, the logo component can function as a power button and depressing the logo component can turn the device on and off. In other implementations, the logo component could perform a variety of other functions for the electronic device.

Claimed and/or described process or method operations can be performed in any order, adding or omitting operations as desired, unless explicitly claimed otherwise or a specific order is inherently necessitated by the claim language.

An example device includes a housing configured to be positioned at two or more housing orientations with respect to a reference. A logo component is rotationally connected to the housing and biased to each of two or more logo orientations with respect to the housing. The logo component is configured to maintain a logo orientation with respect to the reference in all of the housing orientations.

An example device of any preceding device further includes a device stand including an orientation actuator and a rotation mechanism fixedly attached to the logo component. The orientation actuator triggers the rotation mechanism to rotate the logo component to a different one of the logo orientations with respect to the housing when the housing is seated on the device stand.

An example device of any preceding device wherein the reference includes a support structure and the housing includes a housing actuator. The example device further includes a rotation mechanism fixedly attached to the logo component. One of proximity and/or contact of the housing actuator with the support surface triggers the rotation mechanism to rotate the logo component to a different one of the logo orientations with respect to the housing.

An example device of any preceding device further includes a rotation mechanism fixedly attached to the logo component. A weight fixedly attached to the rotation mechanism triggers the rotation mechanism to rotate the logo component to a different one of the logo orientations with respect to the housing when the housing is positioned at a different one of the housing orientations with respect to the reference.

An example device of any preceding device further includes a rotation mechanism fixedly attached to the logo component and configured to rotate the logo component to a different one of the logo orientations with respect to the housing to maintain the logo orientation with respect to the reference. A mechanical stop prevents the logo component from rotating beyond a desired one of the logo orientations when the rotation mechanism is triggered.

An example device of any preceding device further includes a rotation mechanism fixedly attached to the logo component and configured to rotate the logo component to a different one of the logo orientations with respect to the housing to maintain the logo orientation with respect to the reference. A biasing mechanism biases the logo component to each of the two or more logo orientations with respect to the housing.

An example device of any preceding device further includes a rotation mechanism fixedly attached to the logo component and configured to rotate the logo component to a different one of the logo orientations with respect to the housing to maintain the logo orientation with respect to the reference. A dampening mechanism dampens rotation of the logo between the two or more logo orientations with respect to the housing.

An example device of any preceding device wherein the logo component includes two or more logo images. Each logo image is oriented to maintain the logo orientation with respect to the reference in one of the housing orientations. Only the logo image that maintains the logo orientation with respect to the reference is visible at a particular housing orientation.

An example device of any preceding device wherein the logo component is a push actuator for operation of the device.

An example device of any preceding device wherein the logo component is backlit.

An example device of any preceding device wherein the device is one of a gaming console, a desktop computer, a monitor, a speaker, a household appliance, and a consumer product.

An example method of re-orienting a logo on a device includes positioning the device at a selected one of two or more housing orientations with respect to a reference and rotating a logo component with respect to the housing to maintain a logo orientation with respect to the reference at the selected housing orientation. The logo component is biased to each of two or more logo orientations with respect to the housing.

An example method of any preceding method further includes seating the device on a device stand and triggering a rotation mechanism fixedly attached to the logo component to perform the rotation operation in response to the seating operation.

An example method of any preceding method further includes placing the device in one of proximity and contact with the reference and triggering a rotation mechanism fixedly attached to the logo component to perform the rotation operation in response to the placing operation.

An example method of any preceding method further includes triggering a rotation mechanism fixedly attached to the logo component to perform the rotation operation in response to the positioning operation. A weight fixedly attached to the rotation mechanism rotates the logo component to a different one of the logo orientations with respect to the housing when the housing is positioned at a different one of the housing orientations with respect to the reference.

An example method of any preceding method further includes triggering a rotation mechanism fixedly attached to the logo component to perform the rotation operation in response to the orienting operation and preventing rotation of the logo component beyond a desired one of the logo orientations during the rotation operation.

An example method of any preceding method further includes triggering a rotation mechanism fixedly attached to the logo component to perform the rotation operation in response to the orienting operation and biasing the logo component to each of the two or more logo orientations with respect to the housing.

An example method of any preceding method further includes actuating the logo component to perform a function of the device.

An example method of any preceding method wherein the device is one of a gaming console, a desktop computer, a monitor, a speaker, a household appliance, and a consumer product.

Another example device including a housing configured to be positioned at two or more housing orientations with respect to a reference. A logo component is rotationally connected to the housing and biased to each of two or more logo orientations with respect to the housing. The logo component is configured to maintain a logo orientation with respect to the reference in all of the housing orientations. A device stand includes an orientation actuator, and a rotation mechanism fixedly attached to the logo component. The orientation actuator triggers the rotation mechanism to rotate the logo component to a different one of the logo orientations with respect to the housing when the housing is seated on the device stand.

An example system for re-orienting a logo on a device includes means for positioning the device at a selected one of two or more housing orientations with respect to a reference and means for rotating a logo component with respect to the housing to maintain a logo orientation with respect to the reference at the selected housing orientation. The logo component is biased to each of two or more logo orientations with respect to the housing.

An example system of any preceding system further includes means for seating the device on a device stand and means for triggering a rotation mechanism fixedly attached to the logo component to perform the rotation operation in response to the seating operation.

An example system of any preceding system further includes means for placing the device in one of proximity and contact with the reference and means for triggering a rotation mechanism fixedly attached to the logo component to perform the rotation operation in response to the placing operation.

An example system of any preceding system further includes means for triggering a rotation mechanism fixedly attached to the logo component to perform the rotation operation in response to the positioning operation. A weight fixedly attached to the rotation mechanism rotates the logo component to a different one of the logo orientations with respect to the housing when the housing is positioned at a different one of the housing orientations with respect to the reference.

An example system of any preceding system further includes means for triggering a rotation mechanism fixedly attached to the logo component to perform the rotation operation in response to the orienting operation and means for preventing rotation of the logo component beyond a desired one of the logo orientations during the rotation operation.

An example system of any preceding system further includes means for triggering a rotation mechanism fixedly attached to the logo component to perform the rotation operation in response to the orienting operation and means for biasing the logo component to each of the two or more logo orientations with respect to the housing.

An example system of any preceding system further includes means for actuating the logo component to perform a function of the device.

An example system of any preceding system wherein the system is one of a gaming console, a desktop computer, a monitor, a speaker, a household appliance, and a consumer product.

Another example device includes a housing configured to be positioned at two or more orientations and a logo component rotationally connected to the housing and biased to each of two or more logo orientations with respect to the housing. The logo component is configured to maintain a logo orientation with respect to the all of the housing orientations.

Another example device of any preceding device wherein the housing is integrated into a wearable component, and the housing orientations are associated with orientations in which the wearable device is worn by a user.

Another example device of any preceding device wherein the wearable component is a wristband.

Another example device of any preceding device wherein the housing orientations comprise a first housing orientation in which the wristband is worn such that the housing is located on the inside of a user wrist and a second orientation in which the wristband is worn such that the housing is located on the outside of a user wrist.

The above specification, examples, and data provide a complete description of the structure and use of exemplary embodiments of the described technology. Since many embodiments of the described technology can be made without departing from the spirit and scope of the invention, the invention resides in the claims hereinafter appended. Furthermore, structural features of the different embodiments can be combined in yet another embodiment without departing from the recited claims.

What is claimed is:

1. A device comprising:

a housing configured to be positioned at two or more housing orientations with respect to a reference;

a logo component rotationally connected to the housing and biased to each of two or more logo orientations with respect to the housing, wherein the logo component is configured to maintain one of the logo orientations with respect to the reference in all of the housing orientations;

a device stand including an orientation actuator; and a rotation mechanism fixedly attached to the logo component, wherein the orientation actuator triggers the rotation mechanism to rotate the logo component to a different one of the logo orientations with respect to the housing when the housing is seated on the device stand.

2. The device of claim 1, further comprising:

a hard stop that prevents the logo component from rotating beyond a desired one of the logo orientations when the rotation mechanism is triggered.

3. The device of claim 1, further comprising:

a biasing mechanism that biases the logo component to each of the two or more logo orientations with respect to the housing.

4. The device of claim 1, further comprising:

a dampening mechanism that dampens rotation of the logo component between the two or more logo orientations with respect to the housing.

5. The device of claim 1, wherein the logo component includes two or more logo images, each logo image oriented to maintain the logo orientation with respect to the reference in one of the housing orientations, wherein only the logo image that maintains the logo orientation with respect to the reference is visible at a particular housing orientation.

6. The device of claim 1, wherein the logo component is a push actuator for operation of the device.

7. The device of claim 1, wherein the logo component is backlit.

8. The device of claim 1, wherein the device is one of a gaming console, a desktop computer, a monitor, a speaker, a household appliance, and a consumer product.

9. A method comprising:

positioning a device at a selected one of two or more housing orientations with respect to a reference;

seating the device on a device stand; and triggering a rotation mechanism fixedly attached to a logo component to rotate the logo component with respect to a housing to maintain one of two or more logo orientations with respect to the reference at a selected housing orientation in response to the seating operation, wherein the logo component is biased to each of the logo orientations with respect to the housing.

10. The method of claim 9, further comprising:

preventing rotation of the logo component beyond a desired one of the logo orientations.

11. The method of claim 9, further comprising:

biasing the logo component to each of the two or more logo orientations with respect to the housing.

12. The method of claim 9, further comprising:

actuating the logo component to perform a function of the device.

13. The method of claim 9, wherein the device is one of a gaming console, a desktop computer, a monitor, a speaker, a household appliance, and a consumer product.

14. A device comprising:

a housing configured to be positioned at two or more orientations;

a logo component rotationally connected to the housing and biased to each of two or more logo orientations with respect to the housing, wherein the logo component is configured to maintain one of the logo orientations with respect to the all of the housing orientations;

a device stand including an orientation actuator; and a rotation mechanism fixedly attached to the logo component, wherein the orientation actuator triggers the rotation mechanism to rotate the logo component to a different one of the logo orientations with respect to the housing when the housing is seated on the device stand.

15. The device of claim 14 wherein the housing is integrated into a wearable component, and the housing orientations are associated with orientations in which the wearable device is worn by a user.

16. The device of claim 15 wherein the wearable component is a wristband.

17. The device of claim 16 wherein the housing orientations comprise a first housing orientation in which the wristband is worn such that the housing is located on the inside of a user wrist and a second orientation in which the wristband is worn such that the housing is located on the outside of a user wrist.

18. A device comprising:

a housing configured to be positioned at two or more housing orientations with respect to a reference;

a logo component rotationally connected to the housing and configured to maintain a logo orientation with respect to the reference in all of the housing orientations;

a biasing mechanism that biases the logo component to each of two or more logo orientations with respect to the housing;

a device stand including an orientation actuator; and a rotation mechanism fixedly attached to the logo component, wherein the orientation actuator triggers the rotation mechanism to rotate the logo component to a different one of the logo orientations with respect to the housing when the housing is seated on the device stand.

* * * * *